US005971826A

United States Patent [19]

Delzompo et al.

[11] Patent Number: 5,971,826

[45] Date of Patent: Oct. 26, 1999

[54] DISPLAY CASE

[76] Inventors: Lisa A. Delzompo, PSC557 Box 3127 FPO AP 96379-3127; Laura L. Buchanan, 3, Lariat La., Rolling Hills Estates, Calif. 90274

[21] Appl. No.: 08/980,486

[22] Filed: Nov. 28, 1997

[51] Int. Cl.[6] ..... A63H 33/00; A47F 5/10

[52] U.S. Cl. ..... 446/75; 211/184

[58] Field of Search ..... 446/8, 69, 71, 446/75; 211/126.2, 184, 186, 189, 195; 312/189, 108

[56] References Cited

U.S. PATENT DOCUMENTS

| | | | |
|---|---|---|---|
| 176,228 | 4/1876 | Kayser | 446/71 |
| 1,600,554 | 9/1926 | Marquis | 446/75 |
| 2,220,469 | 11/1940 | Wouters | 403/205 |
| 3,070,234 | 12/1962 | Deitchman | 211/10 |
| 3,200,943 | 8/1965 | Waterbury . | |
| 3,209,870 | 10/1965 | Johns . | |
| 3,310,905 | 3/1967 | Davis et al. . | |
| 3,624,954 | 12/1971 | Van Der Veken | 446/71 |
| 3,674,175 | 7/1972 | Jaquish | 49/281 |
| 3,773,244 | 11/1973 | Dunlap, III et al. . | |
| 3,808,732 | 5/1974 | Gay et al. . | |
| 3,862,689 | 1/1975 | Taub | 211/126.2 |
| 3,889,805 | 6/1975 | Korton . | |
| 3,892,450 | 7/1975 | Kolster et al. . | |
| 3,911,634 | 10/1975 | Horowitz et al. | 52/79.2 |
| 4,030,235 | 6/1977 | Terzian et al. . | |
| 4,131,227 | 12/1978 | Patton et al. . | |
| 4,147,007 | 4/1979 | Eppich . | |
| 4,165,579 | 8/1979 | Chase . | |

(List continued on next page.)

FOREIGN PATENT DOCUMENTS

| | | | |
|---|---|---|---|
| 1406061 | 6/1964 | France | 446/75 |
| DT 2809231 | 9/1979 | Germany | 446/71 |

OTHER PUBLICATIONS

Box cover for "'97 Collector Starter Case for your 1997 Hot Wheels cars," Mattel, Inc., El Segundo CA 90245 UPC 7429917694, including photo.

Austad's Golf "Gifts" Catalogue, p. 18, photo "A", "Wall of Fame" cabinet for golf balls, models #407–WF33 and 407–WF44.

Insert for "Jammers Quality Cases: Garage, 48 Car Capacity" Plano Molding Company, Plano Illinois 60545, UPC 2409905315 including photo.

Box Cover for "Beakman's World Antworks", ExploraToy, Carson, CA 90746, UPC 8600266545, including photo.

*Primary Examiner*—Paul J. Hirsch
*Assistant Examiner*—Michael B. Priddy
*Attorney, Agent, or Firm*—Marc P. Schuyler

[57] ABSTRACT

A system of display case modules can be connected to form a display case of variable size and configuration for displaying or storing toys and toy action figures. A single display module has shelves to make variable size compartments and has a clear front panel to allow viewing of the toys, which are vertically stacked inside the display module. The shelves can be varied in position so that various sizes of toys can be displayed. In addition, the shelves are tilted slightly backward so that toys lean against a back wall of the display module, thereby resting upright. The display module also has connectors on its sides, top and bottom so that the display module can be connected to other display modules to make a larger display case. The connectors on the sides of the display modules create a hinge mechanism to link display modules side by side, such that the modules can be pivoted in various directions with respect to each other. The connectors on the top and bottom of the display modules permit multiple display modules to be stacked on top of one another, or to be connected to an optional locking plate, facilitating storage of multiple display modules as an integral toy chest.

21 Claims, 8 Drawing Sheets

U.S. PATENT DOCUMENTS 4,233,778 11/1980 Lemelson ..... 446/92
4,285,157 8/1981 Lambert .
4,359,249 11/1982 Fischer ..... 312/198
4,372,522 2/1983 Simeonoff ..... 249/18
4,527,688 7/1985 Jones et al. .
4,543,278 9/1985 Ackerman .
4,550,838 11/1985 Nathan et al. .
4,566,211 1/1986 Gustafson et al. .
4,571,198 2/1986 Barbato et al. .
4,613,047 9/1986 Bushyhead et al. .
4,654,991 4/1987 Jones .
4,667,833 5/1987 Jamison .
4,728,158 3/1988 D'Elia et al. ..... 312/108
4,736,847 4/1988 Wang .
4,740,187 4/1988 Rasmussen et al. .
4,801,023 1/1989 Ecclestone .
4,867,320 9/1989 Jonker .
5,013,278 5/1991 Dixon et al. .
5,069,332 12/1991 Williams et al. .
5,120,262 6/1992 Caine ..... 446/476
5,123,545 6/1992 Hickman .
5,152,710 10/1992 Montgomery .
5,344,022 9/1994 Stahl .
5,351,843 10/1994 Wichman et al. .
5,379,906 1/1995 Levin et al. .
5,417,603 5/1995 De Chazal ..... 446/75
5,424,137 6/1995 Stagl .
5,458,521 10/1995 Todd .
5,495,954 3/1996 Schmit .
5,544,751 8/1996 Klodt et al. .
5,603,410 2/1997 Kara .

FIG. 1
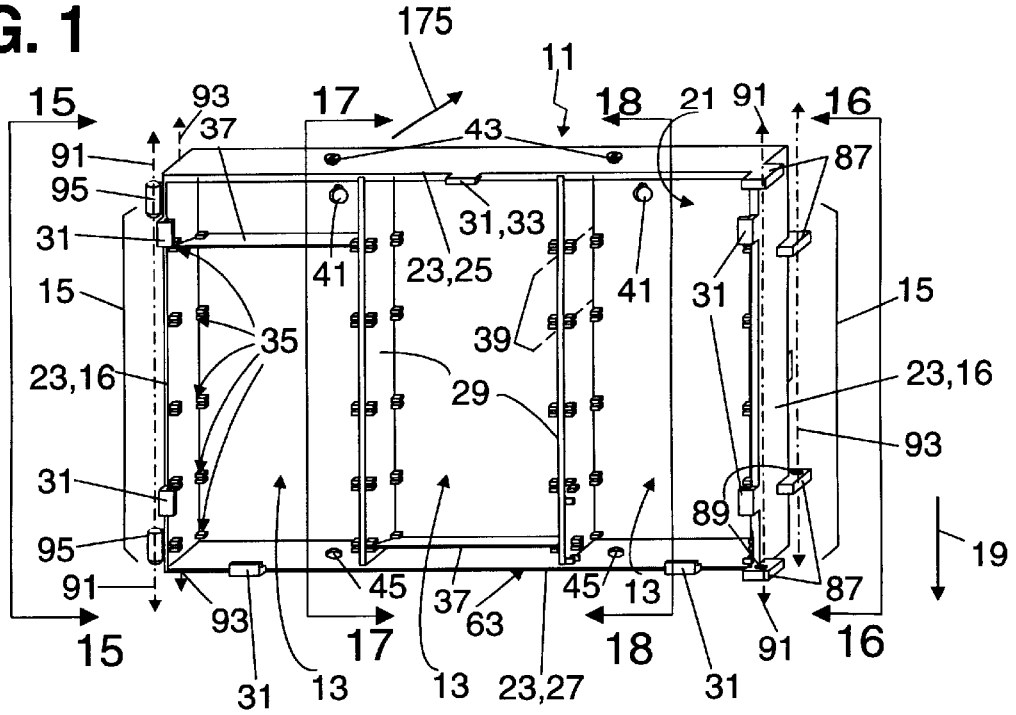
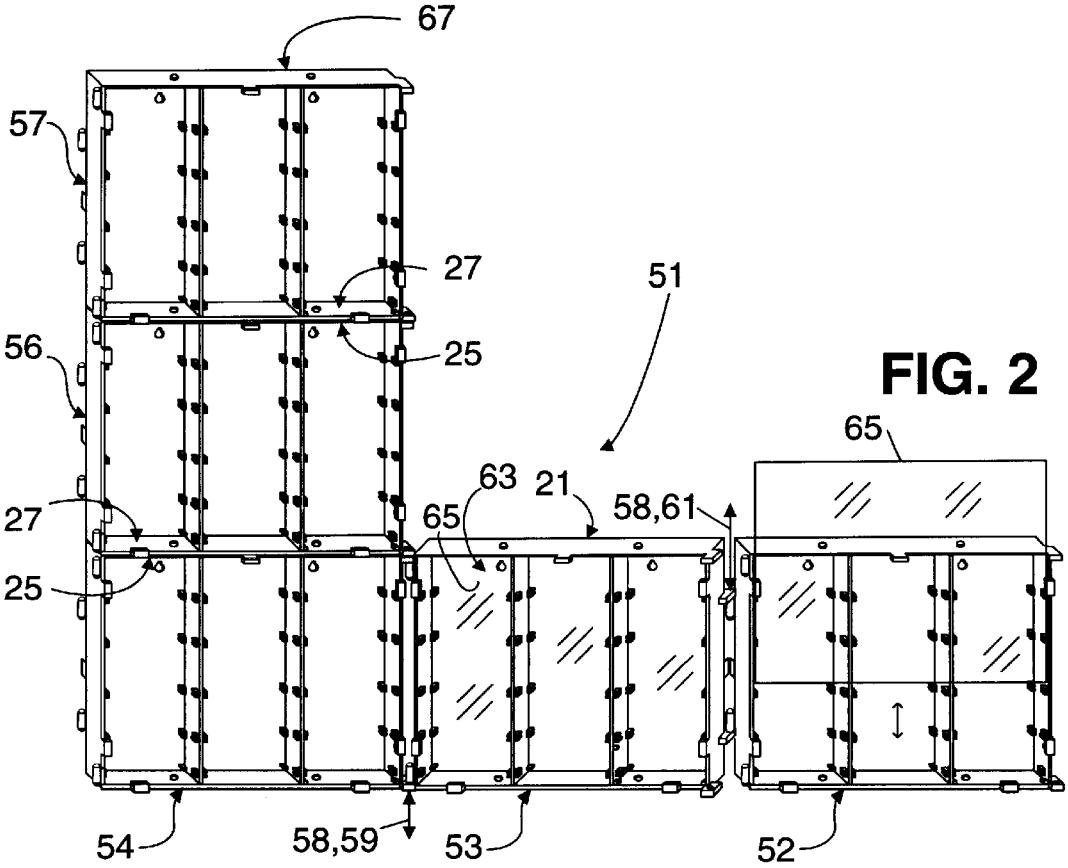
FIG. 2

FIG. 13
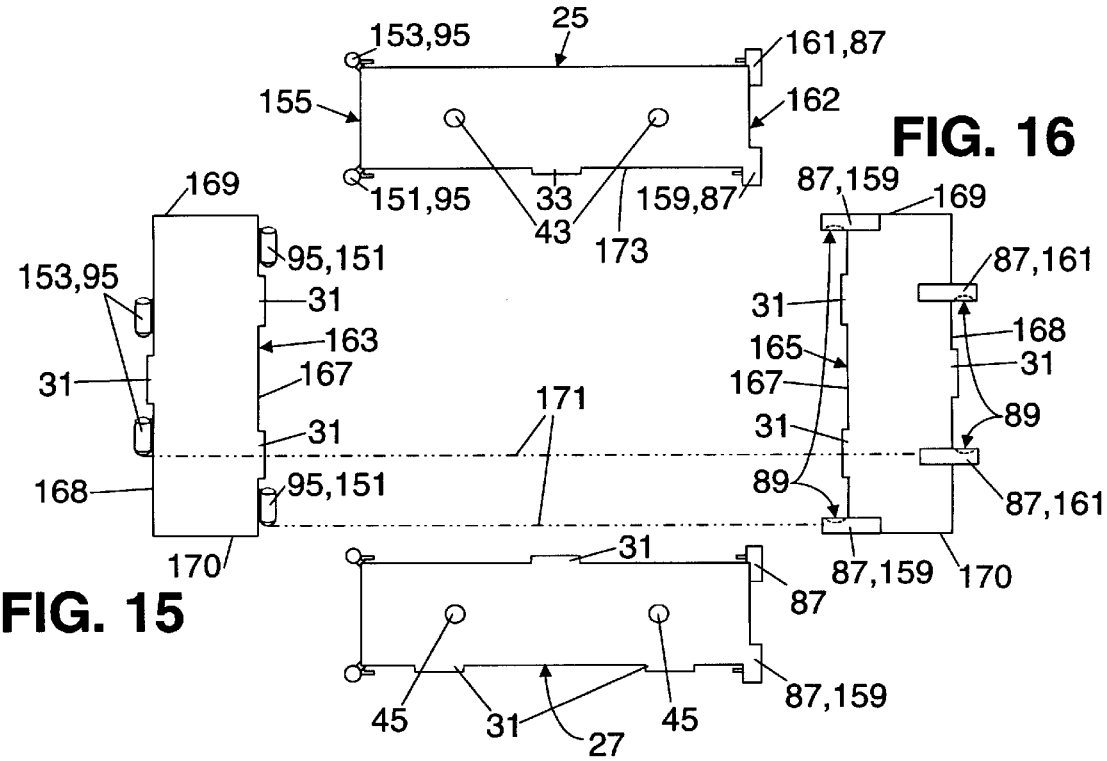
FIG. 16
FIG. 15
FIG. 14
FIG. 17
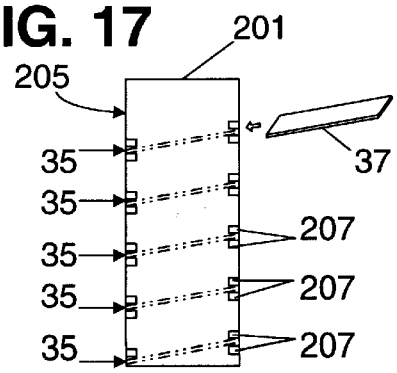
FIG. 18
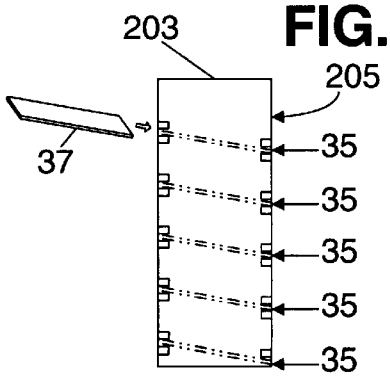

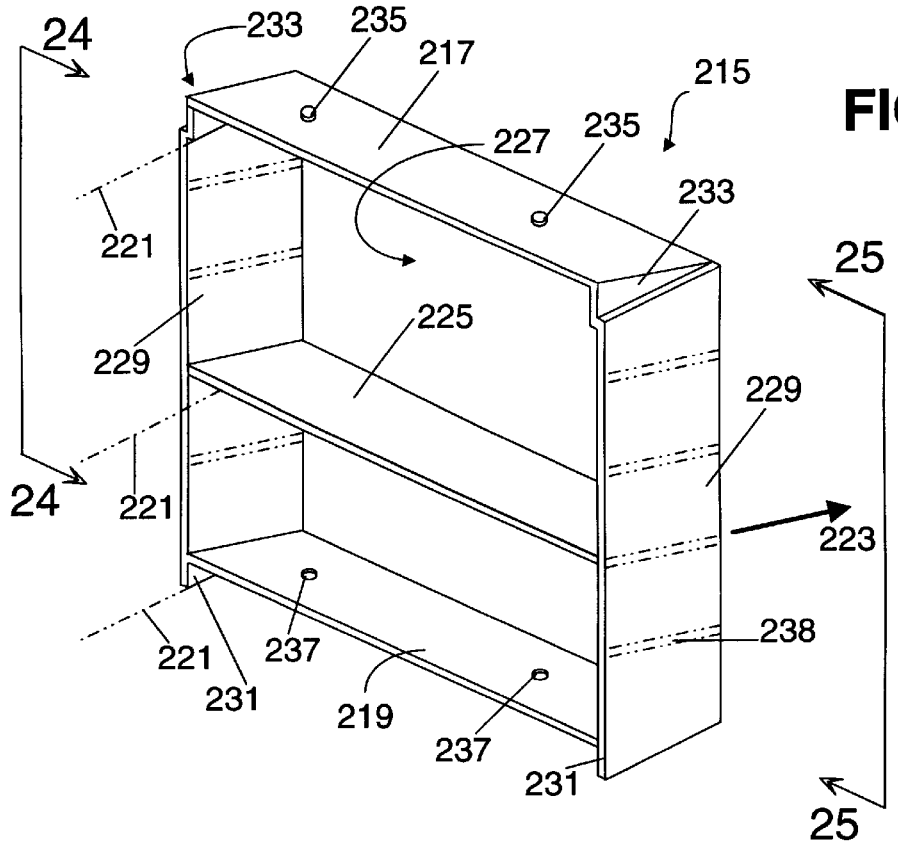
FIG. 23
FIG. 24
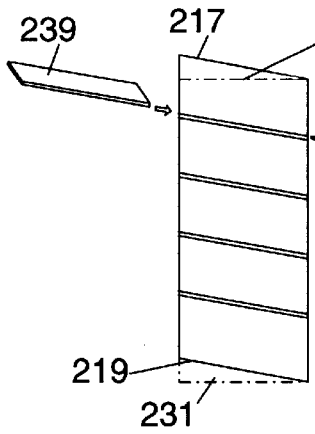
FIG. 25
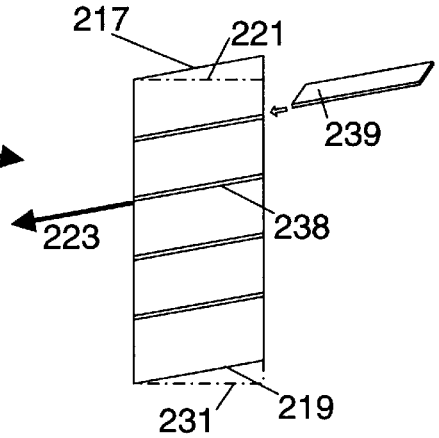

DISPLAY CASE

The present invention relates to a toy display case. In particular, the present invention provides a toy display case with a modular connector for connecting to other toy display case modules, and for receiving different types of toys and displaying them in a natural and intended manner.

BACKGROUND

Toy chests are a traditional solution to the problem of storing toys. However, many toy chests are designed such that a large number of toys and accessories are all jumbled together, making it difficult to find particular toys and their various parts. Toy action figures and dolls often come with small accessories, such as helmets, swords, tennis rackets and other parts, which can be especially difficult to keep track of. Furthermore, many of today's toys, including action figures and dolls and the like, are desirably displayed to children during storage; however, conventional toy chest design typically is directed to storage only and is not compatible with this desired end.

Display cases represent attempts to address the aforementioned problems. For example, it is known to use display cases for arranging and storing miniature cars. However, many display cases allow only a limited view of toys, for example, in requiring toys to be inserted in a particular manner or requiring an opaque cover or compartment to be opened before the toys can be viewed. Also, many of the display cases are formed to receive only certain defined toys; for example, a hypothetical case might include a dozen receptacles for only receiving miniature cars by one manufacturer, e.g., the cars all have to be of approximately the same size. Further, display cases often do not allow a natural and intended display of toys; in the case of action figures and dolls, toy display cases typically do not display the toys such that the toys "stand up." Toy display cases are also frequently intended as standalone units, and are not compatible aesthetically or mechanically with other display cases. Considered in connection with the problem that toy display cases are frequently specially adapted for one type of toy only, or one manufacturer's toys only, the typical format of display cases is not very flexible. Finally, the few display cases which are expandable to accommodate large numbers of toys are sometimes not adapted for easy storage as when, for example, a child is required to move or put away the display cases or toys.

A definite need exists for a flexible toy display case which can aesthetically display toys in a natural and intended manner and which can receive a variety of toys. Further, a need exists for a display case suited for storage of toy accessories, such as toy swords or tennis rackets and the like. Ideally, such a display case should be easily expanded, to provide storage space for more toys, yet be easily moved and stored when display is not desired. The present invention solves these problems and provides further, related advantages.

SUMMARY OF THE INVENTION

The present invention provides a toy display case which solves the aforementioned needs. In particular, it provides a flexible toy display case that can store action figures, dolls and other toys such that they are displayed in an aesthetic manner, for example, to "stand up." The toy display case also is preferably modular, such that one case can serve as the basis for later addition of additional modules, to form a larger toy case, or a toy chest, which can be selectively folded and stored. Finally, use of a modular connection mechanism for performing lateral modular connection enables a series of linked toy display case modules to be oriented to fit within the confines of nearly any room geometry. As can be seen, therefore, this disclosure provides a novel toy display case that should find ready application in displaying and storing many different types of toys in nearly any desired manner.

A first form of the invention provides a toy display case having a back wall and at least one peripheral wall mounted to the back wall; the back wall can be almost any shape, for example, circular with a single cylindrical peripheral wall. Alternatively, the back wall can be made polygonal or another shape, with peripheral (top, side and bottom) walls defining an enclosure for toys. Irrespective of the number of peripheral walls, on each lateral side of the display case, a modular connection mechanism is provided for attaching another toy display case, such that several toy display cases can be connected side-by-side in modular form, to form a large connected case. In more detailed features of this form of the invention, the modular connection mechanisms can be configured to have four different hinge axes, so that adjacent display cases can be rotated to pivot their respective front and back sides toward and away from each other. In addition, the display case can include a transparent front wall, for easy viewing of stored toys, and a vertical modular coupling (on the top and the bottom of the device), for stacking multiple display cases.

A second form of the invention provides a substantially rectangular toy display case having a modular connection mechanism, substantially adjacent each side wall, for connecting at each side wall to another display case; this connection mechanism can be almost any device for coupling modules side by side, and can include a hinge mechanism such that adjacent modules can be pivoted with respect to each other. In this manner, individual modules may be added to form an aggregate display case of almost any desired size, and adjacent modules may be pivoted to fit within the confines of any given room; for example, adjacent display modules may be oriented to fit within a room corner. Alternatively, modules may be pivoted in an accordion-like manner for efficient storage and snapped to a bottom locking plate.

A third form of the invention provides a toy display case having shelves which are tilted slightly backward, to urge toys supported by the shelves to lean against a substantially vertical back wall; in this manner, action figures, dolls and other toys can be displayed in a natural manner, e.g., such that they stand upright.

The invention may be better understood by referring to the following detailed description, which should be read in conjunction with the accompanying drawings. The detailed description of particular preferred embodiments, set out below to enable one to build and use particular implementations of the invention, is not intended to limit the enumerated claims, but to serve as particular examples thereof.

BRIEF DESCRIPTION OF THE DRAWINGS

FIG. 1 is a perspective view of a preferred toy display case embodying the principles of the present invention, including modular connectors on each lateral side of the toy display case.

FIG. 2 is a perspective view of a plurality of the toy display case of FIG. 1; in particular, FIG. 2 shows three laterally adjacent toy display cases connected together by hinge mechanisms permitting adjacent toy cases to be pivoted around a vertical axis. FIG. 2 also shows vertical stacking of three toy display cases.

FIG. 3 shows simultaneous use of two connections, between first and third hinge parts and second and fourth hinge parts, such that the modules are connected together in a completely extended position.

FIG. 13 is a view of a top wall of the preferred toy display case of FIG. 1.

FIG. 14 is a view of the bottom wall of the preferred toy display case of FIG. 1.

FIG. 15 is a view of the right side wall of the preferred toy display case of FIG. 1.

FIG. 16 is a view of the left side wall of the preferred toy display case of FIG. 1.

FIG. 17 is a side view of an interior lateral wall of the preferred toy display case, taken along lines 17—17 of FIG. 1. FIG. 17 shows a set of protruding knuckles for defining multiple shelf positions for optional insertion of shelves at a five-to-fifteen degree angle from horizontal, to urge toys to lean against the back wall.

FIG. 18 is a side view of an interior lateral wall of the preferred toy display case, taken along lines 18—18 of FIG. 1. FIG. 18 shows a set of protruding knuckles for defining multiple shelf positions for optional insertion of shelves at a five-to-fifteen degree angle from horizontal, to urge toys to lean against the back wall.

FIG. 23 is a perspective view of an alternative toy display case, namely, one where the top and bottom walls are parallel to the preferred shelf orientation, i.e., five-to-fifteen degrees off of horizontal, inclined downward toward the back wall.

FIG. 24 is an interior side view of a left side wall of the toy display case of FIG. 23, taken along lines 24—24 of FIG. 23.

FIG. 25 is an interior side view of a right side wall of the toy display case of FIG. 23, taken along lines 25—25 of FIG. 23.

DETAILED DESCRIPTION

Figure 3:
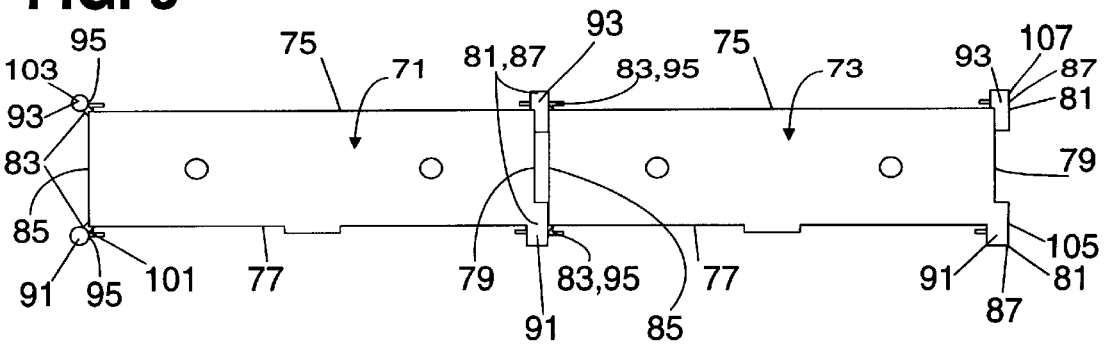
FIG. 3 is a plan view showing the preferred modular connection between laterally adjacent toy display cases used as modules; in particular.
Figure 4:
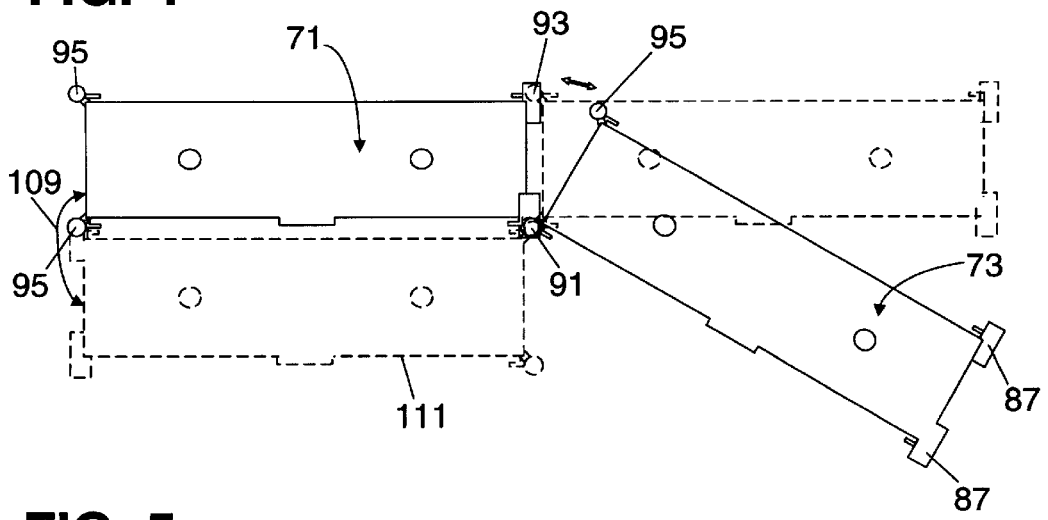
FIG. 4 is a plan view similar to FIG. 3, but in which one of the two connections of FIG. 3 has been broken, thereby permitting pivot about the remaining connection; a pivoting module is seen in phantom in an extended position and also a front-to-front position where the two modules have their front walls adjacent each other.
Figure 5:
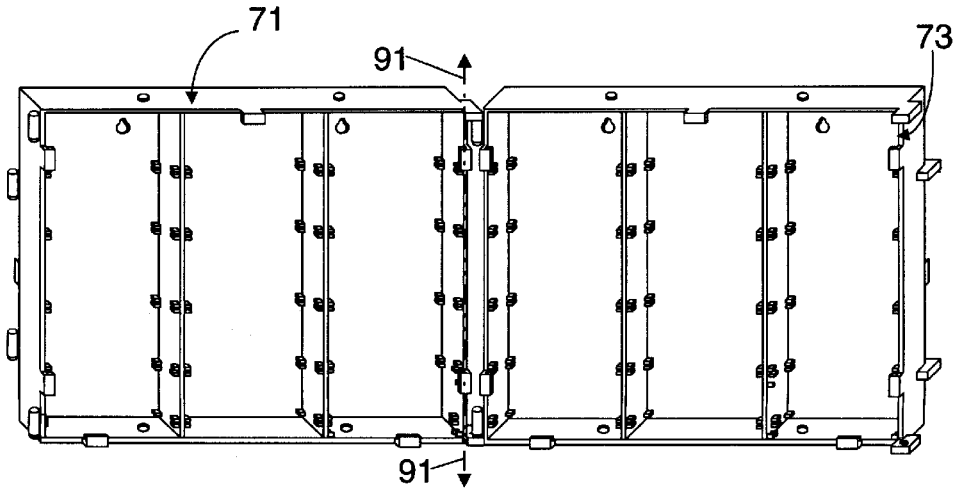
FIG. 5 is a front perspective view of the two display case modules of FIG. 4.

The invention summarized above and defined by the enumerated claims may be better understood by referring to the following detailed description, which should be read in conjunction with the accompanying drawings. This detailed description of a particular preferred embodiment, set out below to enable one to build and use one particular implementation of the invention, is not intended to limit the enumerated claims, but to serve as a particular example thereof. The particular example set out below is the preferred specific implementation of a toy display and storage device. The invention, however, may also be applied to other types of systems as well.

I. Introduction to the Principal Parts.

In accordance with the principles of the present invention, FIG. 1 shows a preferred toy display case 11 which provides three permanent compartments 13 for storing toys. As seen in FIG. 1, the toy display case is generally rectangular in shape, and has a modular connection mechanism 15 at each of its two lateral sides 16, for connecting to other toy display cases. While the modular connection mechanism can be nearly any mechanism for mechanically connecting adjacent toy display cases together, preferably, a mechanism is used which permits adjacent toy cases to be pivoted about at least one vertical axis 19 with respect to one another, so as to fit within the contours of nearly any room.

The toy display case 11 is seen to have a back wall 21, as well as a peripheral wall 23 which connects to the back wall to form one or more compartments 13 that will receive toys. Since the toy display case is preferably rectangular in shape, the peripheral wall 23 seen in FIG. 1 includes four walls, including a top wall 25 that serves as a ceiling for the toys, a bottom wall 27 which will generally rest adjacent ground or another flat surface, and the two side walls 16. In addition to the side walls, the embodiment seen in FIG. 1 also has two permanent vertical partitions 29 which together divide the toy display case into the three permanent compartments. Each compartment 13 is preferably at least about fourteen inches high, five inches wide, and three inches deep, for storing at least one conventional doll or action figure (many common dolls and action figures are on the order of about twelve inches in height). Lastly, the toy display case can be made to receive a transparent front wall (not seen in FIG. 1) using a set of tabs 31; these tabs generally have an inward facing flange which guides the front wall in close proximity to the display case, except for one tab 33 (in the top wall) which is short and flat with a notch in its underside for snapping to the front wall. The front wall retains toys generally within the three compartments while permitting view of the toys by children. The front wall should be made of clear or tinted plastic, and is removable so that children can selectively store and remove toys. Ideally, the front wall is also made as light as practical, so as to minimize any risk of injury to children's fingers resulting from accidental dropping of the wall.

As seen in FIG. 1, the toy display case 11 is made to stand in a vertically upright position, as denoted by the reference axis 19, which points vertically downward toward the pull of gravity. The toy display case is made to display toys in an upright manner such that, for example, action figures and dolls "stand." To this end, the vertical partitions 29 and interiors of the side walls 16 (and the three permanent compartments they define) each include multiple pairs of shelf engagement mechanisms 35, that receive optional shelves 37 at different vertical heights; by mounting shelves at none or a selective one or more of the heights, a child can divide the compartments vertically, to further form additional compartments of varying height (e.g., so as to accommodate several four inch tall action figures or toy cars). Importantly, each shelf is received at an angle from horizontal (horizontal being designated by the phantom lines 39 in FIG. 1), such that the shelf leans at a five-to-fifteen degree angle toward the back wall 21 once fully inserted into the toy display case. In this manner, the shelf acts as a floor to support a toy, urging the toy to lean against the back wall and thereby remain substantially upright.

The toy display case 11 also includes a set of keyholes 41 formed in the back wall 21, for mounting the toy display case to a wall or other vertically oriented structure, in much the same manner as one might a picture. In addition, the toy display case includes a vertical engagement mechanism formed in each of the top wall 25 and the bottom wall 27 for stacking modules on top of one another. In the case of the top wall 25, the mechanism is seen in FIG. 1 to be a male connector 43, essentially a cylinder, whereas the bottom wall 27 is seen to have a female connector in the form of an aperture 45. The cylinder has a radial locking notch and an axial slot; adjacent toy display cases 11 are coupled together by inserting the cylinder in the aperture, such that the radial notch engages the aperture, while adjacent cases are decoupled by squeezing each cylinder to reduce slot width and permit disengagement of the corresponding male connector. Using a vertical connection mechanism as has just been described, one may stack toy display cases on top of one another, as well as mount multiple toy display cases to a common locking plate to form a toy chest, as will be described further below.

With the principal mechanical features of a single toy display case thus introduced, the operation and construction of the preferred toy display case will now be described in additional detail.

II. Modular Format of the Preferred Toy Display Case.

FIG. 2 shows five of the preferred toy display case coupled together to form a larger, aggregate toy display case 51. In particular, FIG. 2 shows three display cases 52, 53 and 54 which are laterally adjacent one another and three display cases 54, 56 and 57 that are vertically stacked on top of one another.

The three laterally adjacent cases are seen to be pivoted slightly with respect to one another about vertical axes 58. The preferred embodiment actually permits pivot about two different vertical axes, including one axis 59 which is adjacent the front wall of each toy display case (at either the left side or the right side) and one axis 61 which is adjacent the back wall of each toy display case (at either the left side or the right side). Referring back to FIG. 1, each modular connection mechanism is in the preferred embodiment seen to consist of multiple parts that create two alternative hinges; one hinge, formed at the front side 63 of the toy display case, permits two adjacent cases to be pivoted toward one another, between a position where the cases are lined-up and a position where the cases are front-to-front. In FIG. 2, cases 53 and 54 are seen to be hinged adjacent their front sides, so as to feature their respective front sides pivoted slightly toward each other. On the other hand, cases 52 and 53 are seen to be hinged together by hinge mechanisms adjacent each of their back walls 21, to permit relative pivot between a lined-up position of the two cases and a position where the cases are back-to-back. Using the preferred double-hinge mechanism permits multiple cases to be selectively locked in a lined-up mode (by connecting both hinges at once), or to be hinged for selective pivot in either direction, such that multiple toy cases can be configured to fit within the contours of nearly any room, e.g., in a corner of a room. The double-hinge mechanism also permits a series of toy display cases to be folded up in an accordion-like manner, for compact storage. Importantly, FIG. 2 also shows insertion of an optional transparent, front wall 65 into two of the toy display cases 52 and 53.

FIG. 2 also shows toy display cases 54, 56 and 57 which are vertically stacked on top of one another. Unlike the modular connection mechanism which was just described (the hinge mechanisms), modular connection formed by the vertical engagement mechanisms locks vertically-stacked cases 54, 56 and 57 together and does not permit relative pivot between them. The three vertically-stacked cases seen in FIG. 2 are coupled together in a manner that features the top wall 25 of one case engaging the bottom wall 27 of another case, via the male and female connectors mentioned earlier. Since cases stacked vertically are snugly locked together, vertical stacks (such as the three vertically stacked cases seen at the left of FIG. 2) will pivot as a panel 67 with respect to other laterally adjacent toy display cases 52 and 53. Although not seen in FIG. 2, each of the three laterally adjacent toy display cases 52 and 53 could include additional vertically-stacked toy display cases on top of them, such that they also would form panels (e.g., nine toy display cases could be arranged to generally form a square).

Additional details on the use of a double-hinge mechanism and vertical engagement mechanism as the preferred modular connection mechanisms are found further below.

A. Use of a Double-Hinge to Connect Adjacent Cases.

Figure 9:
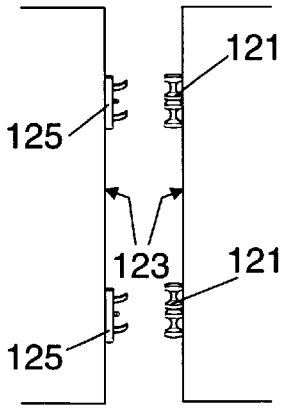
FIG. 9 is a view similar to FIG. 8, but which shows an alternative hinge mechanism for the back of a toy display case.
Figure 10:
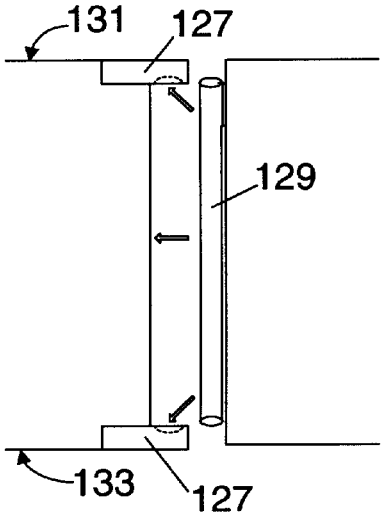
FIG. 10 is a view similar to FIG. 8, but which shows another alternative hinge mechanism for the front of a toy display case.
Figure 11:
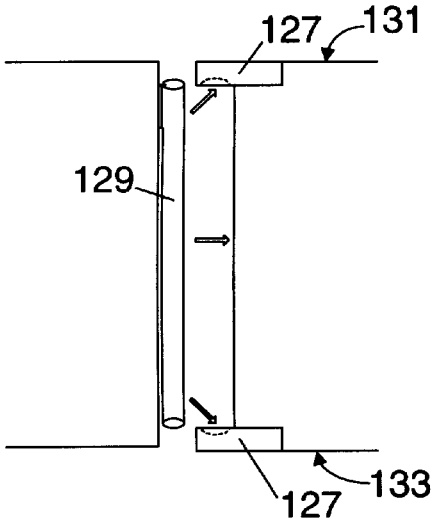
FIG. 11 is a view similar to FIG. 9, but which shows another alternative hinge mechanism for the back of a toy display case.

Several sets of double-hinge mechanisms will be described below. The preferred mechanism is described first, with reference to FIGS. 3–7, and includes a set of vertically extending thumbs and receiving recesses seen in FIG. 1. An alternative hinge mechanism which includes a set of hooks and receiving spools is then described with reference to FIGS. 8–9. Finally, FIGS. 10–11 are used to describe a connection mechanism similar to the preferred mechanism, but which uses solid rods which span substantially the entire height of the toy display case, instead of the vertically-extending thumbs mentioned above. Importantly, a double-hinge mechanism is not the only type of modular connection, but is preferred because it permits adjacent modules to be pivoted about either of two vertical axes, such that adjacent cases can be folded front-to-front or back-to-back, and stored in an accordion-like manner.

FIG. 3 shows a plan view of two similar toy display cases 71 and 73 which are engaged side-by-side. Each toy display case includes a back wall 75, optional front wall 77, and two side walls each having a modular connection mechanism for connecting to other toy display cases. A left side wall 79 includes a first modular connection mechanism 81, which is adapted to couple a second modular connection mechanism 83 mounted upon the right side wall 85 of each toy display case. As best seen in FIG. 1, the first modular connection mechanism 81 includes four horizontally extending flanges 87, each supporting a recess 89 which faces either up or down to engage a corresponding thumb; two of the flanges are vertically aligned to form a first hinge part (and define a first pivot axis 91), while the other two flanges are vertically aligned to form a second hinge part (and define a second pivot axis 93). FIG. 1 also shows mounted upon the right side wall a set of thumbs 95, each thumb extending either vertically upward or downward to engage a corresponding recess. Two of the thumbs vertically align to form a third hinge part (and also define another first pivot axis 91) while the other two thumbs vertically align to form a fourth hinge part (and also define another second pivot axis 93). All of the thumbs and flanges are arranged such that the pivot axes are formed at a forty five degree angle off of the side walls, such that adjacent cases can pivot front-to-front or back-to-back leaving little space remaining in between display cases.

To make the preferred toy display case (including first and second hinge parts, e.g., the aforementioned thumbs, and third and fourth hinge parts, e.g., the flanges) in a single injection mold process, the second and fourth hinge parts should be vertically offset from the first and third hinge parts as reflected in FIG. 1. It is difficult to otherwise remove a complete display case from a mold, or to fabricate a toy display case without intricate mold design or additional labor. Preferably, the set of thumbs and flanges which are near the front side are positioned relatively close to the top and bottom walls, while the thumbs and flanges which are near the back wall are offset from the top and bottom walls by at least a few inches.

The thumbs and recesses which form pivot axes are not the only type of hinge parts that can be used, and several alternative hinge mechanisms are described further below.

Returning to FIG. 3, however, it is seen that the first 101, second 103, third 105 and fourth 107 hinge parts can all be snapped to their counterparts simultaneously, to thereby retain the two illustrated cases in a lined-up mode. By selectively decoupling one of the two hinges, the display cases may be pivoted such that their front walls approach each other, as seen in plan view in FIG. 4 and illustrated in perspective view in FIG. 5. If desired for storage, the cases may be pivoted to place their respective front walls in abutment, and have their respective hinge mechanisms used to lock the cases at a third point into a front-to-front mode, as designated by the numeral 111 of FIG. 4. As indicated by the reference numeral 109, two adjacent cases can be locked in a front-to-front mode by connecting them together by both of their first vertical pivot axes.

Figure 6:
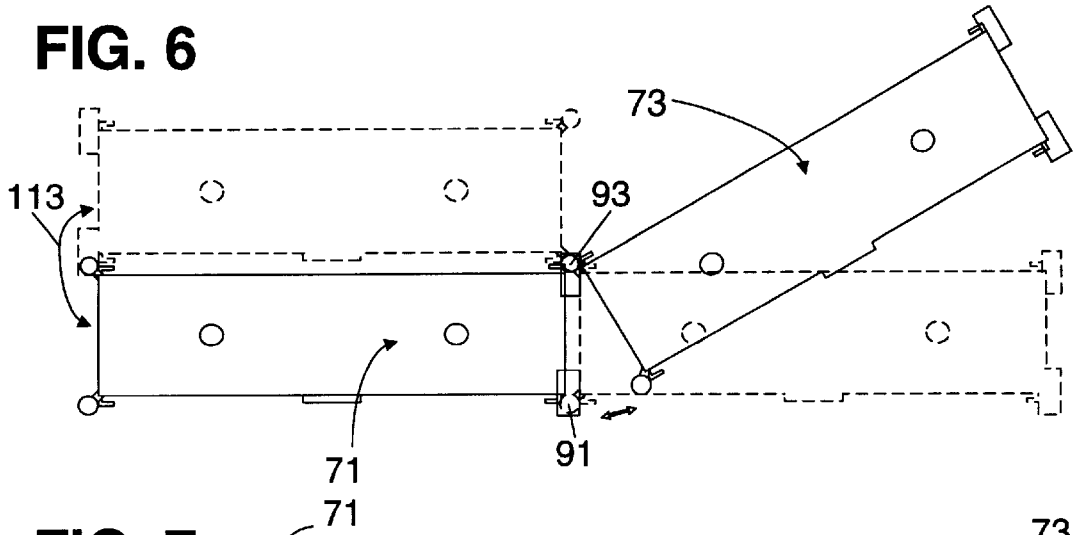
FIG. 6 is a plan view similar to FIG. 3, but in which one of the two connections of FIG. 3 has been broken, thereby permitting pivot about the remaining connection; a pivoting module is seen in phantom in an extended position and also a back-to-back position, where the two modules have their back walls adjacent each other.
Figure 7:
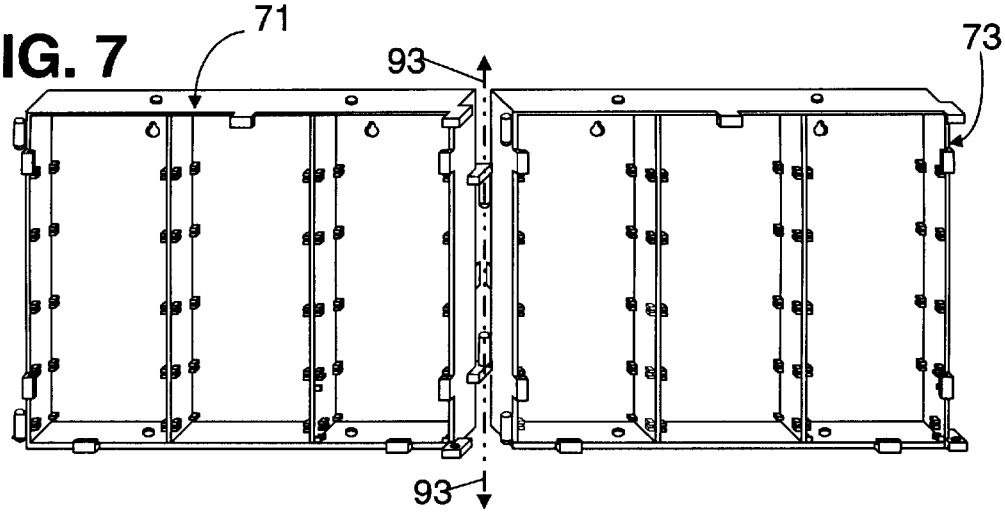
FIG. 7 is a front perspective view of the two display case modules of FIG. 6.

The two display cases 71 and 73 can also have their first pivot axis 91 decoupled, such that the back walls of the display cases may be pivoted toward each other, as best seen in FIGS. 6 and 7. The cases may then be moved toward a locked position in a back-to-back mode, as designated by the numeral 113 in FIG. 6, which may be preferred where it is desired to compactly store the toys, yet permit display to children. As will readily be apparent, the multiple toy display cases may be pivoted and coupled together in almost any manner, e.g., such that three cases are coupled in an equilateral triangle arrangement.

FIGS. 8–11 show alternative hinge mechanisms and, more particularly, show a hinge mechanism using detachable hooks (FIGS. 8–9) and a vertical rod (FIGS. 10–11).

Figure 8:
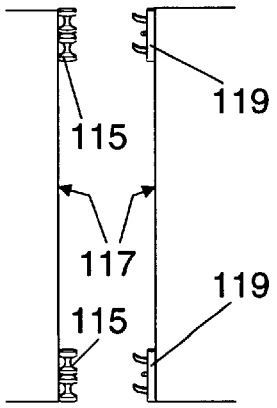
FIG. 8 is a close up view of an alternative hinge mechanism for the front of a toy display case.

As seen in FIG. 8, a set of spools 115 are mounted on the left side wall, adjacent a front side 117 of the toy display case, for selective connection with a set of corresponding hooks 119, mounted on the right side wall of each display case. The spools and hooks respectively form first and third hinge parts which connect together to form a first vertical pivot axis adjacent the front wall of the toy display case. Similarly, FIG. 9 shows a set of spools 121 is also mounted on the left side wall, adjacent the back side 123. Notably, the spools adjacent the back wall are mounted more closely together than the spools adjacent the front wall (FIG. 8) such that hooks 125 on the right side wall intended for mating engagement with the hooks may be clearly differentiated from the set of hooks seen in FIG. 8. The hooks and spools of FIG. 9 respectively form second and fourth hinge parts which, when connected together establish a second vertical pivot axis between modules, enabling the pivot of adjacent modules to a back-to-back relationship.

FIGS. 10 and 11 provide yet another connection mechanism, using horizontally extending flanges 127 to establish first and third hinge parts with corresponding rods 129; each rod has ends adapted to snap to a locked engagement with corresponding flanges. Unlike the embodiments described in reference to FIGS. 1–9, the embodiment of FIG. 10 uses hinge parts which are mounted at the same vertical height, i.e., the horizontally extending flanges 127 are mounted to be substantially integral with the top and bottom walls 131 and 133, and are not intermediate to the height of the toy display case. Importantly, the embodiment of FIGS. 10 and 11 can be constructed by gluing the rods at the front and back edges of the right side lateral wall of the toy display case; however, this construction is not preferred, since it is expected that a single molding of parts without additional required assembly (of rods to side walls) will yield a relatively less expensive and more durable product.

B. Vertical Engagement Between Adjacent Cases.

Figure 12:
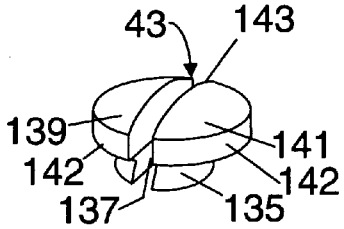
FIG. 12 is a close-up perspective view of a vertical connection mechanism seen on the top wall of FIG. 1.

FIG. 12 shows the preferred vertical engagement mechanism of the top wall 25 (of FIG. 1). As mentioned earlier, the top wall includes a generally cylindrical male connector 43 which extends vertically above the top wall by approximately one-half inch, and includes a radial locking notch 135 and an axial slot 137. The axial slot in the cylinder defines two prongs 139 and 141, which are moved between a normal state toward a compressed state; the prongs have middle portions 142 which occupy a greater radial area than either a distal end 143 of the cylinder or the locking notch 135; to couple the top wall of one toy display case to the bottom wall of another, the two cylinders of the top wall are simply aligned with and inserted into the apertures in the bottom wall of a second toy display case. The presence of the axial slot 137 permits the prongs to flex toward each other and the locking notch 135 to engage radial edges of the aperture in the bottom wall. The locking notch defines an abrupt shoulder in the male connector, and so, unless the two prongs are deliberately squeezed together, the locking notch remains engaged with a corresponding aperture in the bottom wall.

III. Configuration of the Main Body.

FIGS. 13–16 illustrate the preferred toy display case from top, bottom, right and left sides, respectively. Preferably, the entire toy display case from FIG. 1 is formed of polystyrene (or other suitable plastic) in a single injection mold process, each wall having a thickness of approximately three millimeters. The plastic may be any color desired, although either a clear plastic, or tinted red or blue plastic for accentuating the appearance of displayed toys, is preferred.

As seen in FIG. 13, first and second hinge connectors 151 and 153 (e.g., thumbs 95) are mounted at front and back corners on the right side 155 of the display case, while the third and fourth connectors 157 and 159 (e.g., flanges 87) are mounted adjacent the left side wall 162 of the toy display case. The top wall also mounts a front tab 33 which can be used to retain the transparent front wall against the display case, by covering an otherwise open compartment.

FIG. 14 illustrates the bottom wall 27, including apertures 45 for receiving the vertical connection mechanism of another module underneath the display case, as well as front and back tabs 31 that receive and guide the transparent front wall, for selectively engaging the front wall in either a position in which it covers otherwise open compartments of the toy display case, or in which it is stored behind the back wall of the toy display case.

FIGS. 15 and 16 illustrate the right and left side walls 163 and 165 of the display case, taken along lines 15—15 and 16—16 of FIG. 1. In particular, each side wall includes a front end 167, a rear end 168, and top and bottom ends 169 and 170. As seen in FIGS. 15 and 16, each side wall also has tabs 31 at the front and rear ends for engaging a front wall when used either as a transparent front to the toy display case, or when attached to the back of the display case for storage when not in use. As indicated by horizontal phantom lines 171 extending between FIGS. 15 and 16, the vertically extending thumbs 95 of the right side wall are positioned to snugly engage notches 89 in the horizontally extending flanges 87 in the left side wall, and to permit selective attachment and detachment along either vertical pivot axis.

Unlike the tabs on the side walls and the bottom wall, a downward facing tab 33 on a front edge 173 of the top wall is made only to snugly engage the transparent front wall when the front wall is installed on the display case. The transparent front wall (which is preferably cut from a sheet of three millimeter thick polystyrene) is installed by inserting the front wall between the tabs associated with the side walls and the bottom wall; each of these brackets has an inward flange which restrains the front wall from movement away from the device. The tab on the top wall 25, however, relies principally upon a small downward flap or retaining notch in the downward facing side of the tab, which is used to engage the front wall. For snapping the front wall into position, the front wall is guided into the tabs of the side walls and the bottom walls and is then pushed gently backward to snap under the flap (or notch); the flap or notch is made slight enough such that the front wall may be disengaged only by a slight amount of pressure pulling the front wall away from the toy display case, and then sliding the wall out of the tabs of the side and bottom walls.

Preferably, the toy display case is molded as a single unit without any subsequent labor, other than in mounting the front wall to the display case and including optional shelves at the time of packing. The embodiment seen in FIGS. 10 and 11 is for this reason not preferred.

A. Considerations in Forming a Mold.

A mold generally includes two parts which completely envelope an item to be produced such as, for example, the preferred display case. Mold designs typically are constrained to allow separation of the mold, and a cooled toy display case to be neatly pushed out of the mold. For this reason, design of the top, side and bottom walls, and the hinge mechanisms and vertical engagement mechanisms are practically constrained. For example, the preferred embodiment seen in FIG. 1 features peripheral walls which are perpendicular to the back wall; the illustrated embodiment is preferably pushed, back wall last, out of a mold in a direction parallel to the lateral walls (in the opposite a depth dimension 175). To this effect, the hinge parts described earlier (and the shelf engagement mechanisms described below) preferably do not overlap each other in the depth dimension, facilitating molding of the hinge parts with less than two mold halves and easy removal of a toy display case from a mold. Notably, the configuration of tabs (and knuckles for shelves of the front panel) to detachably receive and guide the front wall is inconsistent with this principal, and may in practice be accommodated by providing a set of openings in the back wall which align with the tabs in a direction in which the mold will be separated and a finished toy display case will be removed from the mold.

Several embodiments are described both above, relating to hinge parts, and below, relating to optional mounting of shelves. The various features of these embodiments may readily be mixed with one another, though these features are not preferred because of the molding considerations just described.

Preferably, the toy display case is molded from polystyrene which is approximately three millimeters thick. It is believed that three millimeters thickness is a suitable balance of strength versus weight, so as to both provide a durable toy case, yet one which minimizes any risk of injury to children.

IV. Interior Surfaces and Shelves.

FIGS. 17 and 18 illustrate left facing and right facing interior surfaces 201 and 203 of the side walls or the vertical partitions that subdivide the display case into three compartments. As seen in these figures, a number of shelf engagement mechanisms 35 are configured to receive one or more shelves 37 at an angle of inclination toward the back wall. The shelves preferably are formed of two or three millimeter thick clear polystyrene, and may be cut from the same material as used for the transparent, front wall. As mentioned earlier, the angle of inclination is selected to be approximately five-to-fifteen degrees off horizontal, such that a toy resting upon the shelf (which acts as a floor) is urged to lean at a five-to-fifteen degree angle toward the back 205 of the toy display case. Each mechanism pair is mounted at substantially the same vertical height and is configured to mount shelves in parallel with each other, such that all shelves have the same tilt toward the back wall. Each pair of shelf engagement mechanisms preferably includes pairs of small protruding knuckles 207, which define between them a slot for receiving one shelf; one exception to the use of knuckle pairs in each pair of facing walls, is best observed with respect to FIG. 1, where it is observed that the bottom-most shelf is retained adjacent the back wall 21 between one knuckle and the bottom wall 27. As seen in FIGS. 17 and 18, the shelf engagement mechanisms in each wall or partition generally include four knuckles; preferably, a counterpart set of four knuckles is located on an opposite vertical wall or partition, such eight knuckles are used to receive each shelf. The knuckles are positioned so as to mount each shelf in a substantially perpendicular relationship to the side wall and partitions, i.e., the knuckles are positioned so as to receive a shelf from the front of the display case in a sliding manner, and to allow each shelf to snugly engage the back wall of the display case, and act as a floor upon which toys can rest.

As can be seen from the foregoing, the design of the preferred embodiment provides significant flexibility in permitting a child to mount shelves 37 at any of a number of desired heights, and in permitting a child to subdivide compartments to receive many different types of toys. For example, FIGS. 17 and 18 define five different pairs of shelf engagement mechanisms. Each one of these mechanisms can receive a shelf, such that each of the three permanent compartments (FIG. 1) can be subdivided into up to six different vertically-separated compartments for storing toys. Alternatively, a child could use only one shelf, for example, in the topmost mechanism, to define a tall bottom compartment and a small upper compartment. Preferably, the size of the preferred case is such that each vertical compartment (without any installed shelves) can accommodate at least a fourteen inch tall doll or action figure.

Figure 19:
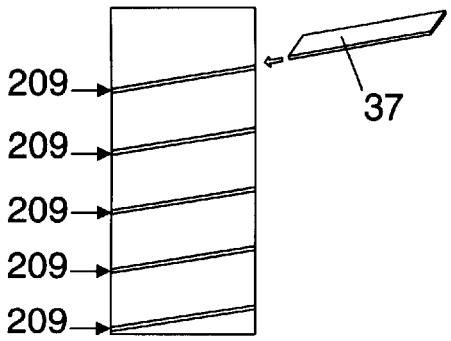
FIG. 19 is a view similar to FIG. 17, but which presents an alternative mechanism, an angled groove, for receiving shelves at a five-to-fifteen degree angle from horizontal.
Figure 20:
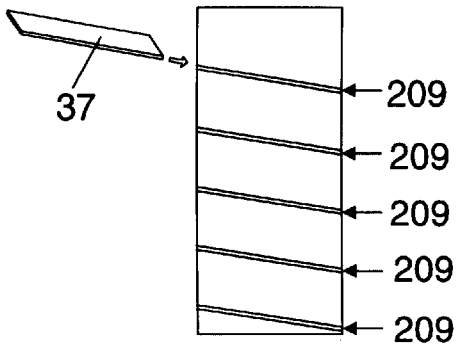
FIG. 20 is a view similar to FIG. 18, but which presents an alternative mechanism, an angled groove, for receiving shelves at a five-to-fifteen degree angle from horizontal.
Figure 21:
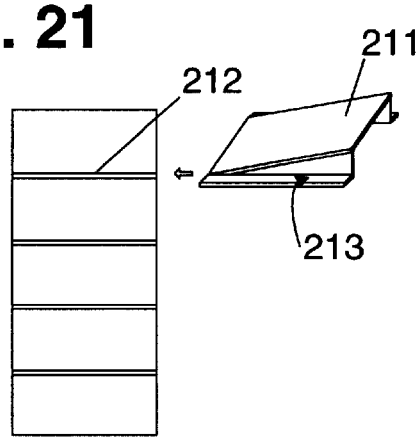
FIG. 21 is a view similar to FIG. 17, but which presents a second alternative for receiving shelves at a five-to-fifteen degree angle from horizontal, namely, a horizontal groove.
Figure 22:
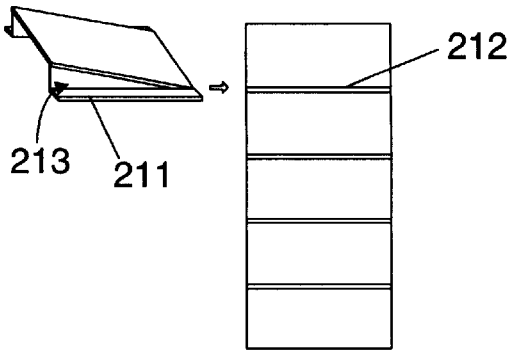
FIG. 22 is a view similar to FIG. 18, but which presents a second alternative for receiving shelves at a five-to-fifteen degree angle from horizontal, namely, a horizontal groove.

FIGS. 19 and 20 show an alternative shelf engagement mechanism, namely, one which uses slots 209 defined in each vertical wall or partition for receiving shelves; the use of knuckles as described earlier is preferred, because it is difficult to pull the mold apart with a display case having grooves as seen in FIGS. 19 and 20. FIGS. 21 and 22 illustrate a second alternative embodiment having somewhat complex shelf design; in particular, each shelf 211 is seen to be wedge-shaped, with lateral "legs" 213 which can be received into grooves 212 in the vertical walls or partitions. Unlike the embodiment of FIGS. 19 and 20, since the grooves of FIG. 21 are parallel to the top and bottom walls, the embodiment of FIG. 21 may readily be molded. The embodiment of FIG. 21 is not preferred, however, due to the complex design required for each shelf.

FIGS. 23–25 present yet another embodiment 215 of the toy display case, where top and bottom walls 217 and 219 of the toy display case are also inclined at a five-to-fifteen degree angle with respect to horizontal (indicated by phantom lines 221 in FIG. 23). As mentioned earlier, lateral grooves for optional shelves are generally inconsistent with ability to fabricate the toy display case in a single injection mold process; however, when the top wall 217, bottom wall 219, and any interior surfaces are parallel, a mold may be pulled out of a finished toy display case, not directly forward (as along line 175 of FIG. 1), but instead, in a direction parallel to the top and bottom walls, in the direction indicated by the reference vector 223 in FIG. 23. In this configuration, one or more permanent horizontal shelves 225 may be molded integral with the toy display case, and have a slight angle of inclination toward the back wall 227 to urge toys to lean against the back wall and stand upright.

As depicted in FIGS. 23–25, side walls 229 in this alternative embodiment have legs 231 which extend below the bottom wall and create the potential for improper fit with the top wall of another toy display case when vertically stacking multiple toy display cases. On the other hand, since the bottom wall 219 is inclined at a five-to-fifteen degree angle from horizontal, the legs 231 are desired to optionally support each toy display case upon the ground or another flat surface in an upright manner. To address this potential improper fit, the top wall preferably includes at either lateral end a shoulder portion 233 which snugly fits in between the legs of each toy display case. In this manner, the bottom walls and top walls may be connected via the preferred male and female connectors 235 and 237, yet a bottom toy display case in a vertical stack can rest upon ground vertically upright, supported by its legs 231. The side walls may also include grooves 238 for receiving optional shelves 239 in parallel to the top and bottom walls.

A. Use of a Receiving Well.

Figure 26:
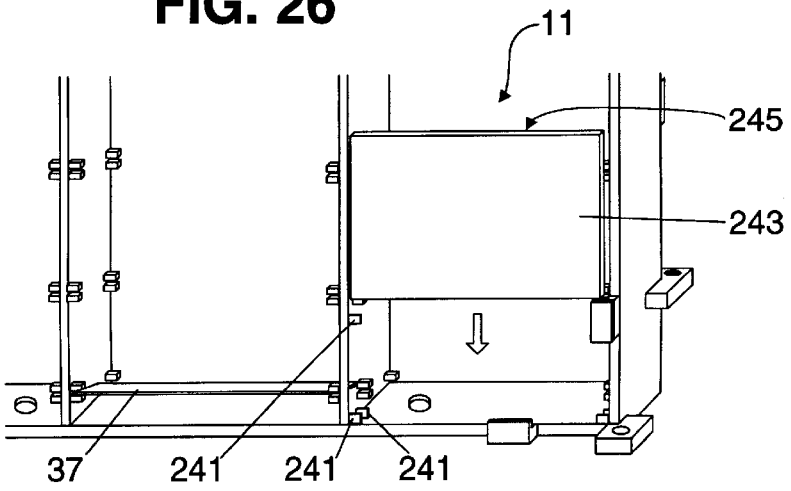
FIG. 26 is a close-up view of the lower front right corner of the preferred toy display case of FIG. 1, used to illustrate the use of additional knuckles to permit selective insertion of a front partition, to define a well for receiving toys.

The preferred toy display case 11 also includes front partition knuckles 241 on the right side wall and on a side of the adjacent vertical partition which opposes the right side wall, as seen in FIG. 26. These knuckles allow insertion of a rectangular front partition 243 to create an enclosed well 245 inside the toy display case, for action figures' accessories, such as toy guns and swords. A shelf can then be put in the toy display case immediately above the top of the front partition to enclose the area for accessories completely. It is also preferable to make the front partition equal in size to the shelves to simplify and lower overall manufacturing costs for the toy display case.

V. Multiple Display Cases Implemented as a Toy Chest.

Figure 27:
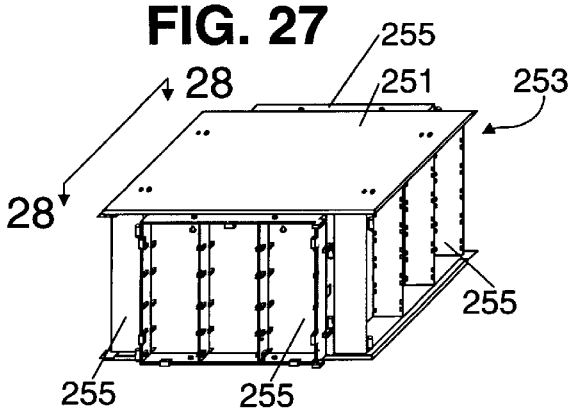
FIG. 27 is a perspective view of an optional toy chest formed by multiple ones of the preferred toy display case, retained together using a locking plate.

A locking plate 251 may be used to lock multiple toy display cases together, and form a toy chest 253 which can be readily stored as a single unit as in FIG. 27. This option permits a child, once multiple toy display cases 255 have been acquired, to form an integral unit that provides a compact and aesthetic display, seen in FIG. 27. Preferably, each set of plates accommodates a number of toy display cases arranged in a polygon, for example, four toy display cases arranged to face outward with a rectangular layout as seen in FIG. 27, or in a fanfold arrangement.

Figure 28:
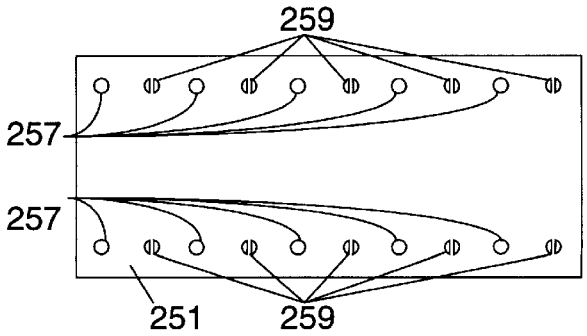
FIG. 28 shows a locking plate similar to the locking plate seen in FIG. 27, taken along lines 28—28 of FIG. 27.

In particular, FIG. 28 shows use of a locking plate 251 which permits multiple levels of toy display cases to be built, with each level supporting multiple toy cases. A locking plate can be used both as a base for multiple toy display cases, and may optionally be used as a ceiling for the multiple toy display cases, or for vertically stacking another set of toy display cases. As best seen in FIG. 28, each locking plate is simply a rectangular sheet of plastic, preferably about five millimeters thick, with pairs of apertures 257 for engaging the male vertical connectors of toy display cases; in between adjacent pairs of apertures, the locking plate also has (on its upward surface) pairs of male vertical connectors 259 for engaging the bottom walls of more toy display cases. Importantly, the use of support mechanism for multiple levels in a polygonal configuration (as seen in FIG. 27) provides a lateral structural support which contributes to structural integrity of a hinged arrangement of toy cases, yet avoids excessive complexity.

As should therefore be apparent, what has been described is a toy display case that is flexible in configuration and expandability, and permits a child to configure one or more display cases in modular fashion to display toys (especially dolls and action figures) in a natural and intended manner, such that these toys "stand-up."

Having thus described an exemplary embodiment of the invention, it will be apparent that further alterations, modifications, and improvements will also occur to those skilled in the art. Such alterations, modifications, and improvements, though not expressly described above, are nonetheless intended and implied to be within the spirit and scope of the invention. Further, it will be apparent that the present invention is not limited to the specific form of display and storage device described above. Accordingly, the foregoing discussion is intended to be illustrative only; the invention is limited and defined only by the following claims and equivalents thereto.

We claim:

1. A display case adapted for modular engagement with other ones of said display case, said display case comprising:

a back wall having a periphery; and at least one peripheral wall, mounted to the periphery of the back wall, the at least one peripheral wall spanning substantially the entire periphery;

wherein the back wall and the at least one peripheral wall combine to form a compartment adapted to receive at least one item for storage, the at least one peripheral wall includes two substantially opposing lateral portions, said display case further comprises a first modular connection mechanism mounted at one of the two substantially opposing lateral portions and a second modular connection mechanism mounted at another of the two substantially opposing lateral portions, and the, said display case thereby forming a modular element adapted to be connected together by engagement between the first modular connection mechanism with a second modular connection mechanism of another of said toy display case, and by engagement between said second modular connection mechanism with a first modular connection mechanism of another of said display case;

the first and second modular connection mechanisms are adapted to mount two adjacent coupled ones of said display case with their respective back walls at an angle with respect to one another.

2. A display case according to claim 1, wherein said display case is adapted to permit display of toy action figures, and further comprises a transparent front wall that is selectively removable from a front side of said display case and a plurality of shelves which are slanted downward toward the back wall, the shelves thereby permitting the toy action figures to rest against the back wall and to appear to stand upright for viewing through the transparent front wall.

3. A display case according to claim 1, wherein:

said display case includes four peripheral walls, including two lateral walls each lateral wall including one of the substantially opposing lateral portions, a top wall and a bottom wall;

the top wall includes a first vertical engagement mechanism;

the bottom wall includes a second vertical engagement mechanism; and the first vertical engagement mechanism and the second vertical engagement mechanism are adapted for engagement with each other to form a modular attachment with another, vertically adjacent one of said display case.

4. A display case according to claim 3, wherein:

the first vertical engagement mechanism includes a male connector; and the second vertical engagement mechanism includes a female connector.

5. A display case according to claim 3, wherein:

said display case further comprises a multiple display case locking plate, the locking plate also having a first vertical engagement mechanism, adapted to engage said second vertical engagement mechanism of the bottom wall.

6. A display case according to claim 1, wherein:

the first modular connection mechanism includes first and second hinge parts, each mounted on one of the two substantially opposing lateral portions at a lateral distance apart;

the second modular connection mechanism includes third and fourth hinge parts, each mounted on one of the two substantially opposing lateral portions at a lateral distance apart;

the first hinge part is adapted for selective engagement and disengagement with the third hinge part of another one of said display case, and the second hinge part is adapted for selective engagement and disengagement with the fourth hinge part of another one of said display case; and said display case is adapted to be connected to another laterally adjacent one of said display case via a hinge formed by one of (a) the first and third hinge parts (to permit the front walls of adjacent toy display cases to be pivoted toward each other when the second and fourth hinge parts are decoupled), and (b) the second and forth hinge parts (to permit the back walls of adjacent display cases to be pivoted toward each other when the first and third hinge parts are decoupled).

7. A display case according to claim 6, wherein:

said display case further comprises a transparent front wall, a top wall, a bottom wall substantially parallel to the top wall, and two substantially parallel side walls;

each of the front wall and the back wall is substantially rectangular, and connects to each of the top wall, the bottom wall and the two side walls, with the front and back wall being maintained parallel and a distance apart, such that the top, bottom, side, front and back walls form a substantially rectangular enclosure;

the first and fourth hinge parts are each adapted to form a hinge axis which is parallel to the back wall, each hinge axis so-formed being diagonally opposite to each other across the top and bottom walls; and the second and third hinge parts are each adapted to form a hinge axis which is parallel to the back wall, each hinge axis so-formed being diagonally opposite to each other across the top and bottom walls.

8. A display case according to claim 1, wherein said display case further comprises:

a top portion of the peripheral wall;

a bottom portion of the peripheral wall; and a vertical partition that extends between the top and bottom portions, to thereby divide the compartment into at least two compartments, such that said display case is adapted to receive an item for display in each compartment.

9. A display case according to claim 1, wherein said case is adapted to display toys and further comprises:

two lateral walls defining at least one compartment between them for receiving a toy;

a plurality of shelf engagement mechanism pairs in the two lateral walls, each pair adapted to detachably receive a shelf;

wherein said plurality of shelf engagement mechanisms are adapted to permit a user to selectively subdivide a compartment between the two lateral walls into at least two compartments for receiving toys by placing a shelf into one of the plurality of mechanism pairs, each of the at least two compartments having an associated vertical height defined by user selection of a shelf engagement mechanism pair.

10. A display case according to claim 1, further comprising:

two lateral walls;

a floor;

a vertical partition adapted to be removably inserted between the two lateral walls, to extend perpendicular to them and laterally between them; and a vertical partition engagement mechanism in each of two lateral walls, the vertical partition engagement mechanism adapted to receive the vertical partition and retain the vertical partition in fixed relation with respect to the lateral walls until the partition is selectively removed;

wherein the vertical partition, together with the two lateral walls and the back wall, form a well for receiving an item for storage.

11. A display case according to claim 1, wherein:

said first modular connection mechanism includes at least two vertically extending thumbs, a first thumb extending in a downward direction and a second thumb extending in an upward direction; and said second modular connection mechanism includes at least two flanges protruding laterally away from said toy display case, a first flange having a recess adapted to mate with the first vertically extending thumb of another one of said display case, and a second flange having a recess adapted to mate with the second vertically extending thumb of another one of said display case.

12. A display case according to claim 1, wherein:

the first modular connection mechanism includes at least one vertically extending connection rod, the connection rod having a first end extending in a downward direction and a second end extending in an upward direction; and the second modular connection mechanism includes at least two flanges protruding laterally away from said toy display case, a first flange having a recess adapted to mate with the first end of a connection rod of another one of said toy display case, and a second flange having a recess adapted to mate with the second end of said rod of another one of said display case.

13. A display case, comprising:

two substantially parallel side walls;

a top wall;

a bottom wall;

a substantially rectangular back wall, having a top, a bottom and two sides, the back wall joined to the top wall at the top end, to the bottom wall at the bottom end, and to a side wall at each side; and a modular connection mechanism mounted externally to said display case, for connecting at each side wall to another one of said display case in side-by-side relationship, wherein the modular connection mechanism is adapted to permit mounting of said display case at an angle with respect to another one of said display case, such that their respective back walls are not parallel.

14. A display case according to claim 13, wherein the modular connection mechanism includes a hinge that connects to another one of said display case side-by-side, while permitting relative pivot between them about a vertical axis.

15. A display case according to claim 13, further comprising variable shelf receiving means for selectively receiving at least one shelf to act as a floor for supporting an item for display at a selective one of plural vertical positions.

16. A display case according to claim 15, wherein said variable shelf receiving means further includes means for receiving a shelf ata slightly downward angle with respect to the back wall, in a manner adapted to urge toy action figures supported on a shelf to lean against the back wall.

17. A display case according to claim 13, further comprising:

a connector in each of the side walls, at a distance away from the back wall; and a removable, transparent front wall adapted to be slidably inserted within the connectors in the side walls and be laterally retained thereby in a substantially parallel relationship with the back wall.

18. A toy display case according to claim 13, further comprising means for vertically stacking multiple ones of said toy display case vertically on top of one another.

19. A toy display case, comprising:

a back wall having a periphery;

a transparent front wall;

at least one peripheral wall, mounted to the periphery of the back wall, the at least one peripheral wall spanning substantially the entire periphery; and wherein the back wall, the transparent front wall, and the at least one peripheral wall combine to form a compartment for receiving a toy, and said toy display case further comprises a mechanism for mounting the back wall and the at least one peripheral wall such that the back wall is substantially vertical, and at least one floor adapted to support a toy inserted within said toy display case, the at least one floor tilted slightly downward toward the back wall, wherein said toy display case is adapted to display toys which are standing in a substantially upright manner upon the at least one floor, while leaning against the back wall.

20. A toy display case according to claim 19, further comprising a plurality of floors, each one of the plurality of floors tilted at a five-to-fifteen degree angle with respect to horizontal and toward the back wall, each floor differentiated from other floors by being one of (a) formed by separate shelves and (b) separated by a vertical partition.

21. A toy display case according to claim 19, further comprising a pivotal modular coupling at each of two lateral ends of said toy display case, said toy display case thereby adapted for modular connection to others of said toy display case and for varied pivotal connection with respect thereto.

* * * * *